US009182088B2

(12) United States Patent
Workman et al.

(10) Patent No.: US 9,182,088 B2
(45) Date of Patent: Nov. 10, 2015

(54) MOBILE LANTERN LIGHTING DEVICE

(71) Applicant: Goal Zero LLC, Bluffdale, UT (US)

(72) Inventors: Robert E. Workman, Morgan, UT (US); Norman L. Krantz, Draper, UT (US); Henry J. Howell, Herriman, UT (US); Jaremy T. Butler, Herriman, UT (US); Walker Ford, Holladay, UT (US)

(73) Assignee: Goal Zero LLC, Bluffdale, UT (US)

( * ) Notice: Subject to any disclaimer, the term of this patent is extended or adjusted under 35 U.S.C. 154(b) by 105 days.

(21) Appl. No.: 14/259,759

(22) Filed: Apr. 23, 2014

(65) Prior Publication Data

US 2014/0321106 A1 Oct. 30, 2014

Related U.S. Application Data

(60) Provisional application No. 61/817,677, filed on Apr. 30, 2013.

(51) Int. Cl.

| | |
|---|---|
| ***F21L 13/00*** | (2006.01) |
| ***F21K 99/00*** | (2010.01) |
| ***F21L 4/02*** | (2006.01) |
| ***F21V 21/06*** | (2006.01) |
| ***F21V 23/00*** | (2015.01) |
| *F21Y 101/02* | (2006.01) |

(52) U.S. Cl.

CPC . *F21L 4/02* (2013.01); *F21V 21/06* (2013.01); *F21V 23/003* (2013.01); *F21Y 2101/02* (2013.01)

(58) Field of Classification Search

CPC ..... F21L 4/02; F21V 21/06; F21V 23/003; F21Y 2101/02

See application file for complete search history.

(56) References Cited

U.S. PATENT DOCUMENTS

2007/0297167 A1* 12/2007 Greenhoe ..... F21S 9/032 362/183
2010/0084997 A1* 4/2010 Oberzeir ..... F21L 4/027 315/313

OTHER PUBLICATIONS

Goal Zero Lighthouse Lantern, product images from TigerDirect.com (www.tigerdirect.com/applications/SearchTools/item-details.asp?EdpNo=8021865&SRCCODE=WEBGOOKWL&cm_mmc_o=mH4CjC7BBTkwCjCs81CjCE&gclid=CPSs7u6O2rkCFctcMgodMRsArA), understood to be publically available Jun. 29, 2011, 6 pages.

* cited by examiner

*Primary Examiner* — Stephen F Husar
(74) *Attorney, Agent, or Firm* — Foley & Lardner LLP

(57) ABSTRACT

A lantern lighting device includes a base portion defining a user interface, an upper portion coupled to the base portion and having an upper cover, an energy storage device disposed within at least one of the base portion and the upper cover, a first LED and a second LED coupled to the upper cover and configured to provide a first and a second light output, a divider coupled to the base portion and the upper cover, and a controller. The divider forms a partition between the first LED and the second LED that separates the first light output from the second light output. The controller selectively engages the first LED in a first operation mode to provide approximately 180 degrees of illumination or that engages both the first LED and the second LED in a second operation mode to provide approximately 360 degrees of illumination.

20 Claims, 12 Drawing Sheets

MOBILE LANTERN LIGHTING DEVICE

CROSS-REFERENCE TO RELATED PATENT APPLICATIONS

This application claims the benefit of priority to U.S. Provisional Patent Application No. 61/817,677, filed Apr. 30, 2013, which is incorporated herein by reference in its entirety.

BACKGROUND

The present application relates to a lighting device. Particularly, the present application relates to a mobile lantern lighting device. The present application further relates to charging systems and methods for storing energy within a mobile lantern device. Lanterns convert stored energy into light energy and illuminate a surrounding environment. Lanterns may be used for generally illuminating a surrounding area or for performing a particular task, such as reading. When performing a particular task, a user may wish to direct light toward only a portion of the surrounding environment.

While a large light output from the lantern may be preferred for general lighting, a reduced light output may be preferred to perform a particular task. Traditional lanterns include one or more lighting sources (e.g., mantels, bulbs, etc.) intended to project light toward a surrounding environment. While a user may vary the light output of the lantern using a switch (e.g., a dial that regulates the flow of fuel to the mantel), the light output of each light source is typically increased or decreased together. Therefore, users generally cannot specify the intensity of a particular light source. Further, traditional lanterns do not allow a user to selectively direct light toward only a portion of the surrounding environment. Despite such lack of control, lanterns with lighting sources controlled in unison remain the primary devices used to illuminate a surrounding environment.

SUMMARY

One exemplary embodiment of the disclosure relates to a lantern lighting device that includes a base portion defining a user interface, an upper portion coupled to the base portion and having an upper cover, an energy storage device disposed within at least one of the base portion and the upper cover, a first LED coupled to the upper cover and configured to provide a first light output, a second LED coupled to the upper cover and configured to provide a second light output, a divider coupled to the base portion and the upper cover, and a controller. The divider is positioned to form a partition between the first LED and the second LED that separates the first light output from the second light output. The controller selectively engages the first LED in a first operation mode to provide approximately 180 degrees of illumination or that engages both the first LED and the second LED in a second operation mode to provide approximately 360 degrees of illumination.

Another exemplary embodiment of the disclosure relates to a lantern lighting device that includes a base portion defining a user interface, an upper portion coupled to the base portion and having an upper cover, an energy storage device disposed within at least one of the base portion and the upper cover, a divider coupled to the base portion and the upper cover, a first LED positioned on a first side of the divider, a second LED positioned on a second side of the divider, the divider forming a partition that at least partially separates a first light output of the first LED from a second light output of the second LED, and a plurality of reflectors. The plurality of reflectors include a base reflector and an intermediate reflector, and the plurality of reflectors are positioned to reflect the first light output and the second light output outward from the base portion.

Still another exemplary embodiment of the disclosure relates to a lantern lighting device that includes a base portion defining a user interface, an upper portion coupled to the base portion and having an upper cover, an energy storage device disposed within at least one of the base portion and the upper cover, a first LED coupled to the upper cover and configured to provide a first light output, a second LED coupled to the upper cover and configured to provide a second light output, a plurality of reflectors, a divider bisecting the plurality of reflectors, and a controller. The plurality of reflectors are coupled to the base portion and the upper cover, the plurality of reflectors include a base reflector and an intermediate reflector, and the plurality of reflectors are positioned to reflect the first light output and the second light output outward from the base portion. The divider is positioned to form a partition between the first LED and the second LED that separates the first light output from the second light output. The controller selectively engages the first LED in a first operation mode to provide approximately 180 degrees of illumination or that engages both the first LED and the second LED in a second operation mode to provide approximately 360 degrees of illumination.

The invention is capable of other embodiments and of being carried out in various ways. Alternative exemplary embodiments relate to other features and combinations of features as may be generally recited in the claims.

BRIEF DESCRIPTION OF THE DRAWINGS

The disclosure will become more fully understood from the following detailed description taken in conjunction with the accompanying drawings wherein like reference numerals refer to like elements, in which.

DETAILED DESCRIPTION

Before turning to the figures, which illustrate the exemplary embodiments in detail, it should be understood that the application may be not limited to the details or methodology set forth in the description or illustrated in the figures. It should also be understood that the terminology may be for the purpose of description only, and should not be regarded as limiting.

Figure 1:
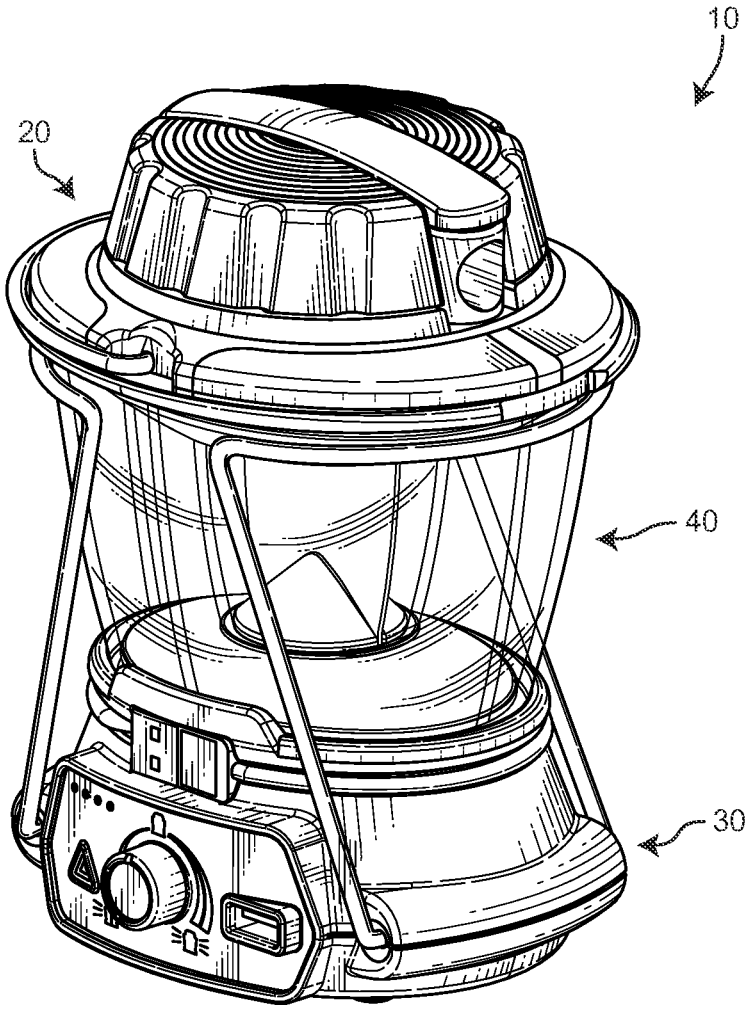
FIG. 1 is a front perspective view of a lighting device having supports folded into a storage position, according to an exemplary embodiment.

According to the exemplary embodiment shown in FIGS. 1-14, a lighting device, shown as lantern 10, is intended to illuminate a surrounding environment. While general lighting may be preferred in some circumstances (e.g., where lantern 10 is utilized to illuminate a room or interior of a tent, etc.), partial lighting may be preferred in other situations (e.g., where lantern 10 is utilized to illuminate a walking path, to provide reading light without illuminating the entire room, etc.). Lantern 10 provides several operation modes that correspond to general and partial lighting. Such flexibility reduces energy consumption relative to traditional lanterns that provide general lighting where partial lighting is sufficient or preferred. Referring to FIG. 1, lantern 10 includes an upper portion 20 and a base portion 30. Upper portion 20 and base portion 30 house various internal components of lantern 10. According to an exemplary embodiment, upper portion 20 and base portion 30 are separated by an intermediate portion 40. Light extends outward from the intermediate portion 40 to illuminate the surrounding environment.

According to an exemplary embodiment, lantern 10 includes a generator configured to produce electricity. The generator may be a dynamo that generates direct current electricity using a magnet and a plurality of wire windings. It should be understood that movement of the magnet relative to the plurality of wire windings induces current. In some embodiments, lantern 10 includes an energy storage device configured to accumulate the electricity generated by the generator for later use. According to an exemplary embodiment, lantern 10 includes one lithium-ion battery cell. In other embodiments, lantern 10 may include a plurality of battery cells, different types of batteries, or other types of energy storage devices (e.g., a capacitor, etc.). The energy storage devices may be fixed or removably secured within at least one of upper portion 20 and base portion 30.

Figure 2:
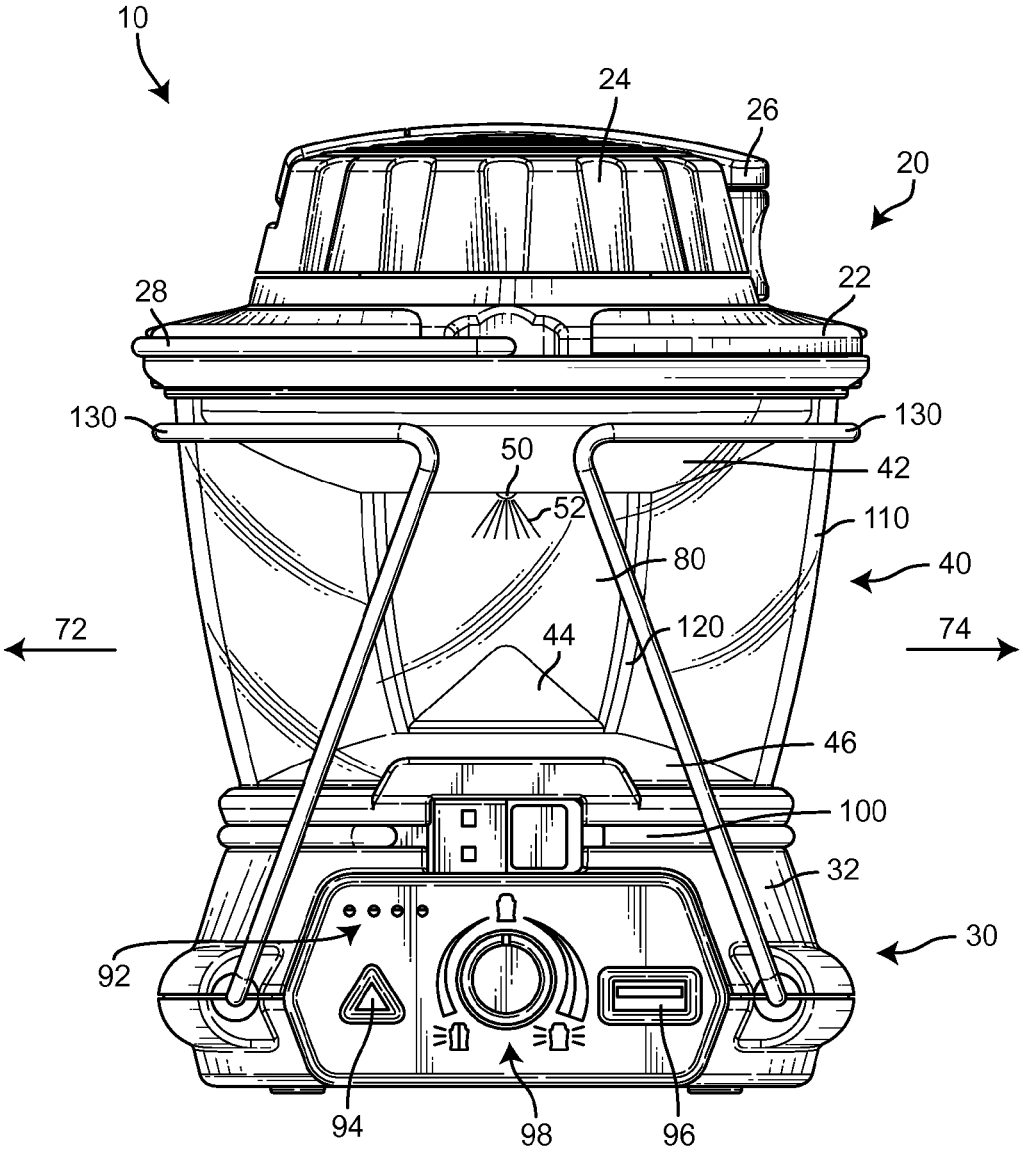
FIG. 2 is a front plan view of the lighting device of FIG. 1.

Referring next to FIG. 2, upper portion 20 includes an upper cover, shown as top plate 22, and a movable hub, shown as hub 24. A user of lantern 10 may rotate hub 24 to generate electricity. According to an exemplary embodiment, hub 24 rotates along its central axis relative to top plate 22. Hub 24 may be coupled to the magnet of the dynamo such that rotation of hub 24 rotates the magnet within the plurality of wire windings. In some embodiments, hub 24 is directly coupled to the magnet of the dynamo (i.e., a user's rotation of hub 24 rotates the magnet at a ratio of 1:1). In other embodiments, hub 24 is coupled to the magnet with at least one intermediate gear. Intermediate gearing may provide a gear reduction such that a user's rotation of hub 24 rotates the magnet at a greater speed. Rotating the magnet at a faster rate may improve the efficiency of the dynamo, may generate more electricity, or may provide still other benefits.

An arm, shown as handle 26, is coupled to hub 24. It should be understood that handle 26 and hub 24 rotate together with respect to top plate 22. According to an exemplary embodiment, handle 26 is rotatably coupled to hub 24 (e.g., with a pin) any may be folded between a storage position and an extended position. A user may unfold handle 26 from the storage position into the extended position and rotate hub 24. Such rotation may be facilitated by a swiveling knob on handle 26. Handle 26 generates a longer lever arm with which a user may apply a turning torque to hub 24 and the generator. According to an exemplary embodiment, handle 26 in the extended position reduces the force needed to rotate hub 24 thereby improving user comfort. After use, handle 26 may be folded into the storage position to improve the portability of lantern 10.

Referring again to FIG. 2, lantern 10 includes a handle, shown as handle 28. Among other uses, a user may carry or hang lantern 10 by handle 28. As shown in FIG. 2, top plate 22 defines a pair of apertures configured to receive ends of handle 28. The handle 28 rotates about the pair of apertures and may be secured on either side of top plate 22 for storage. According to an exemplary embodiment, handle 28 is a rigid metal wire (e.g., steel, etc.). In other embodiments, handle 28 may be otherwise designed (e.g., a plastic handle, a rope, a folding handle, etc.).

Referring specifically to FIGS. 2-5, intermediate portion 40 includes a plurality of surfaces (e.g., reflectors, etc.) intended to reflect light outward from lantern 10 (e.g., outward from base portion 30, etc.). According to an exemplary embodiment, the plurality of reflectors includes an upper reflector 42, an intermediate reflector 44, and a base reflector 46. In some embodiments, upper reflector 42, intermediate reflector 44, and base reflector 46 are manufactured from a reflective material. In other embodiments, upper reflector 42, intermediate reflector 44, and base reflector 46 include a base material and a reflective coating (e.g., a reflective film, a polymeric coating, etc.). In still other embodiments, upper reflector 42, intermediate reflector 44, and base reflector 46 include a diffusive material intended to scatter light and produce an even output light profile.

As shown in the front plan view of FIG. 2, intermediate portion 40 also includes a first light source, shown as light emitting diode (hereinafter LED) 50. While LEDs are discussed herein, it should be understood that other light sources may be similarly positioned and actuated. LED 50 is coupled to top plate 22 with upper reflector 42 and positioned to provide light downward toward base portion 30. According to an exemplary embodiment, LED 50 emits light primarily within a half-intensity cone 52. The intensity of light within half-intensity cone 52 is greater than 50% the intensity of light emitted along a primary axis of LED 50, according to an exemplary embodiment. In some embodiments, LED 50 includes a lens designed to change the shape of half-intensity cone 52 (e.g., a dispersing lens designed to widen half-intensity cone 52, a converging lens designed to narrow half-intensity cone 52, etc.). In other embodiments, LED 50 does not include a lens.

Figure 3:
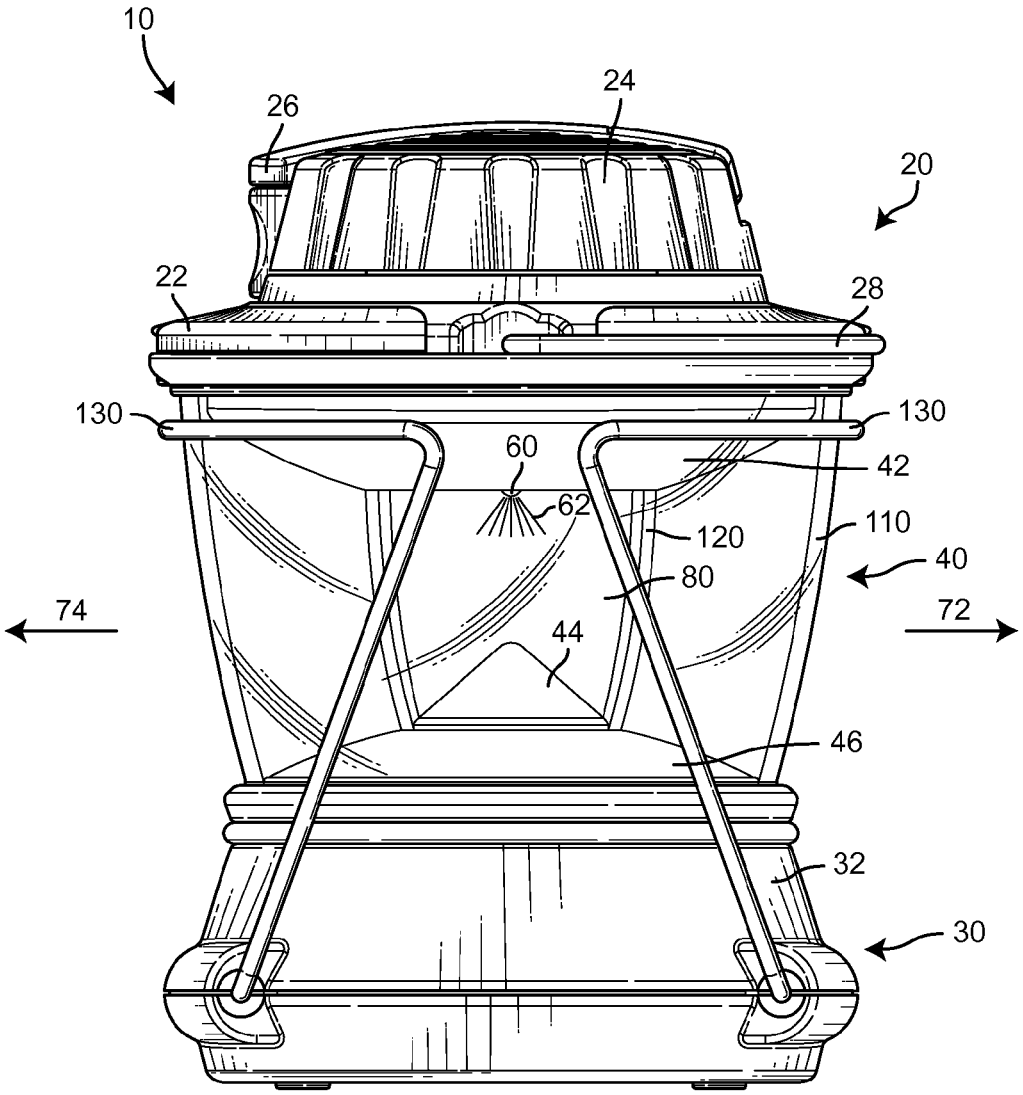
FIG. 3 is a rear plan view of the lighting device of FIG. 1.
Figure 4:
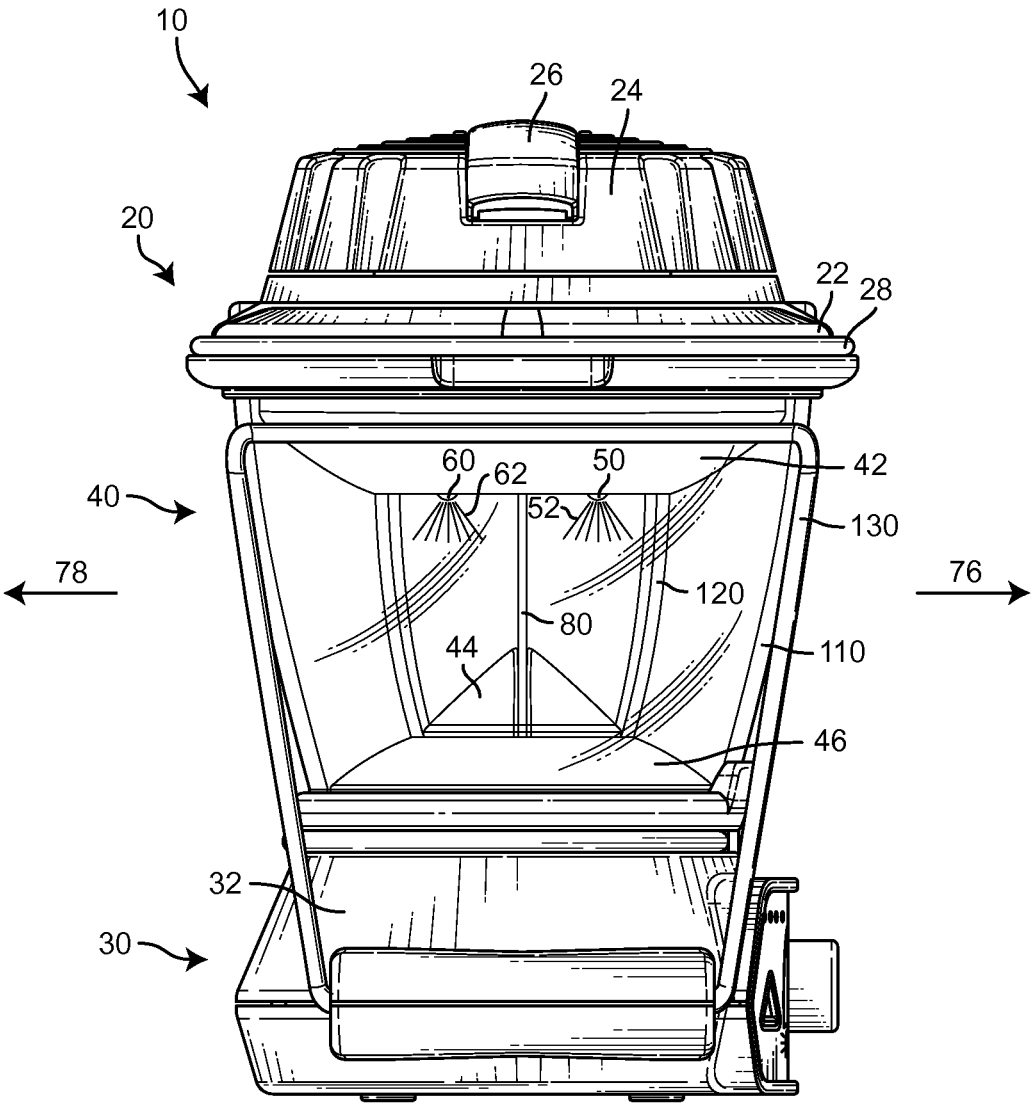
FIG. 4 is a left side plan view of the lighting device of FIG. 1.
Figure 5:
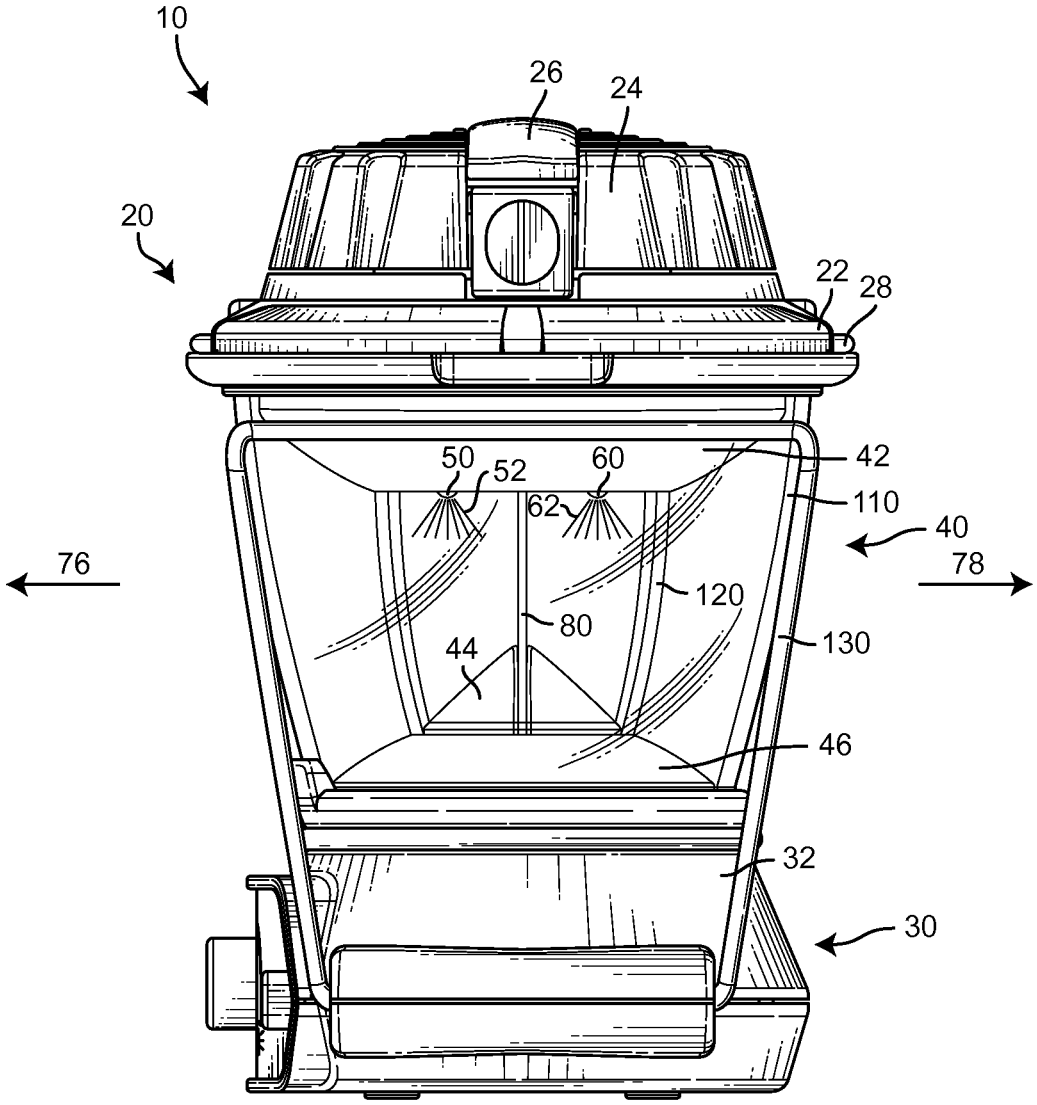
FIG. 5 is a right side plan view of the lighting device of FIG. 1.

As shown in the rear plan view of FIG. 3, intermediate portion 40 includes a second light source, shown as LED 60. LED 60 is coupled to top plate 22 with upper reflector 42 and positioned to provide light downward toward base portion 30. According to an exemplary embodiment, LED 60 emits light primarily within half-intensity cone 62. In some embodiments, LED 60 includes a lens designed to change the shape of half-intensity cone 62. In other embodiments, LED 60 does not include a lens. LED 50 and LED 60 may be multi-colored LEDs including a red, a green, and a blue LED chip, which are all engaged during normal operation of lantern 10 to form white output light. LED 50 and LED 60 may alternatively include blue LEDs and a coating (e.g., a phosphor coating) to form white light. LED 50 and LED 60 are coupled to the energy storage device and draw electrical power therefrom, according to an exemplary embodiment.

Referring again to FIGS. 2-5, intermediate portion 40 of lantern 10 provides light along a plurality of illumination directions. According to an exemplary embodiment, LED 50 and LED 60 direct light primarily downward toward intermediate reflector 44, and light is reflected by intermediate reflector 44 and base reflector 46 outward from lantern 10 along a left lateral direction 72 and a right lateral direction 74. With both LED 50 and LED 60 engaged, light is also reflected along a front direction 76 and an opposing rear direction 78. While "left," "right," "front," and "rear" directions have been specified herein to describe the orientation of light provided by lantern 10, it should be understood that such directional identifiers are included for explanatory purposes only and are not intended to be limiting.

According to an exemplary embodiment, the surfaces of upper reflector 42, intermediate reflector 44, and base reflector 46 are shaped to reflect light along the plurality of illumination directions. As shown in FIGS. 2-5, the surface of intermediate reflector 44 is cone-shaped and includes a base portion that narrows as it extends toward an opposing tip portion. The cone-shaped surface of intermediate reflector 44 is intended to uniformly reflect light from LED 50 and LED 60 along left lateral direction 72, right lateral direction 74, front direction 76, and opposing rear direction 78. In other embodiments, the surface of intermediate reflector 44 is otherwise shaped (e.g., hemispherically shaped, etc.). In still other embodiments, the surface of intermediate reflector 44 may be shaped to non-uniformly distribute light from LED 50 and LED 60 (e.g., wedge shaped to primarily along front direction 76 and opposing rear direction 78, etc.). According to an alternative embodiment, at least one of upper reflector 42, intermediate reflector 44, and base reflector 46 include a lens to further focus or distribute light from LED 50 and LED 60 (e.g., a conventional spherical lens, a parabolic lens, a Fresnel lens, etc.). Such a lens may change the pattern of light provided by lantern 10 (e.g., focus the light to produce a flashlight functionality).

Referring still to the exemplary embodiment shown in FIGS. 2-5, intermediate portion 40 includes a partition, shown as divider 80. By way of example, divider 80 may be disposed along intermediate portion 40. LED 50 is positioned on a first side of divider 80, and LED 60 is positioned on a second side of divider 80, according to an exemplary embodiment. Divider 80 is intended to separate a first light output of LED 50 from a second light output of LED 60. Divider 80 thereby reduces the light from LED 50 that extends along opposing rear direction 78 and the light from LED 60 that extends along front direction 76. As shown in FIGS. 2-5, divider 80 extends laterally across front direction 76 and opposing rear direction 78. According to an alternative embodiment, lantern 10 has four LEDs and divider 80 includes a pair of intersecting panels arranged in the shape of an "X." Such a divider 80 may separate the light outputs of the four LEDs such that each LED provides illumination around approximately 90 degrees of lantern 10. In still other embodiments, divider 80 is otherwise shaped to provide different patterns of light output.

According to an exemplary embodiment, divider 80 bisects the plurality of reflectors. As shown in FIGS. 2-5, divider 80 protrudes from intermediate reflector 44 and divides intermediate reflector 44 into a pair of opposing sides. Divider 80 may include a first opposing surface and a second opposing surface separated by a body portion. In some embodiments, the first opposing surface faces front direction 76, and the second opposing surface faces opposing rear direction 78. The body portion of divider 80 may be manufactured from a base material (e.g., plastic, a silicon based material, etc.) and the first and second opposing surfaces may be formed with a reflective coating. In other embodiments, the first and second opposing surfaces are not reflective or the entire divider 80 is manufactured from a reflective material.

As shown in FIGS. 1-5, divider 80 is a flat plate having a uniform thickness. Referring specifically to FIGS. 2-3, divider 80 extends between a narrow end positioned at base reflector 46 and a wide end positioned at upper reflector 42. The lateral edges of divider 80 are curved thereby forming a parabolic shape extending between the narrow end and the wide end. In other embodiments, divider 80 may have another shape (e.g., a rectangle, a curved shape, a wedge shape, etc.). The shape of divider 80 may affect the light output of lantern 10 (e.g., more light may be directed along one of left lateral direction 72, right lateral direction 74, front direction 76, or opposing rear direction 78, etc.).

Figure 6:
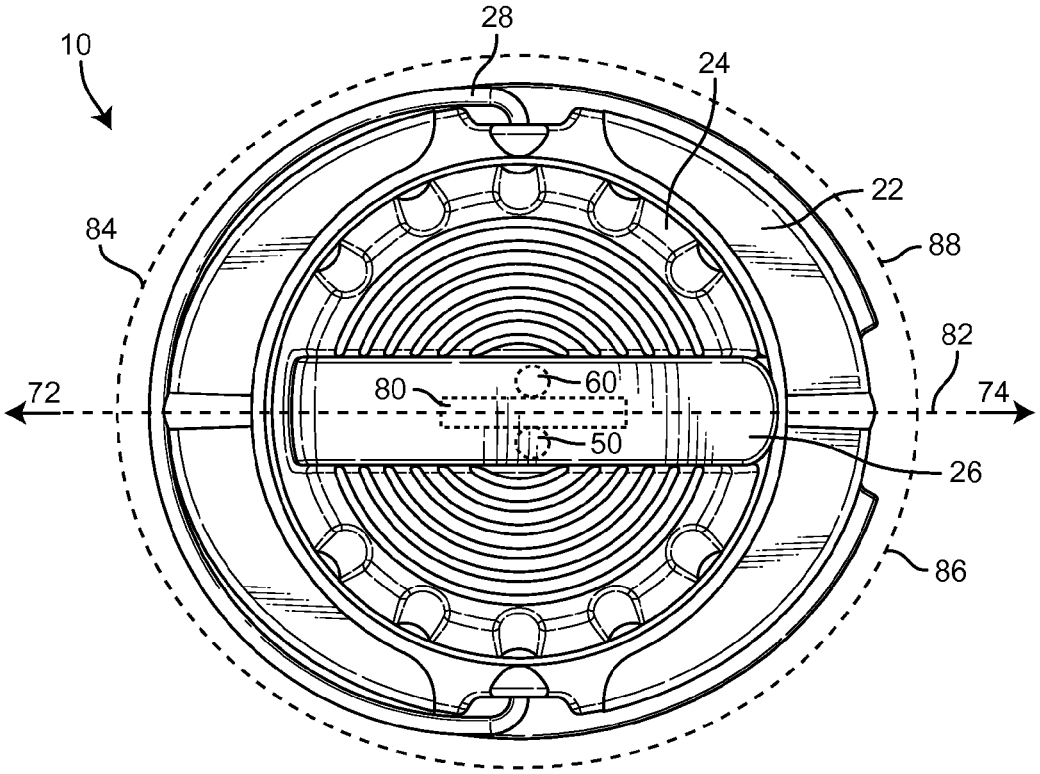
FIG. 6 is a top plan view of the lighting device of FIG. 1.
Figure 7:
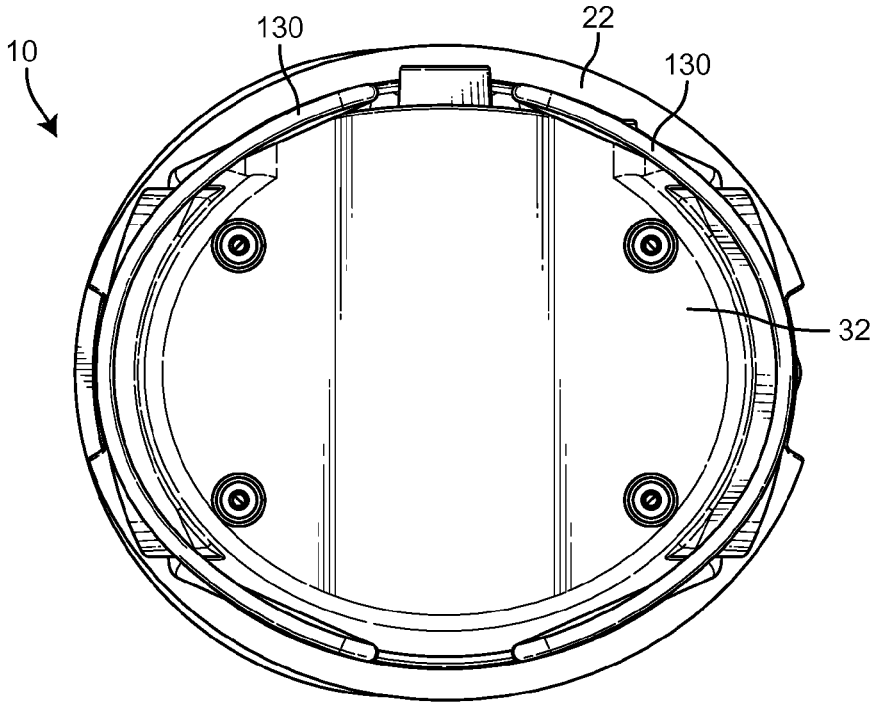
FIG. 7 is a bottom plan view of the lighting device of FIG. 1.
Figure 8:
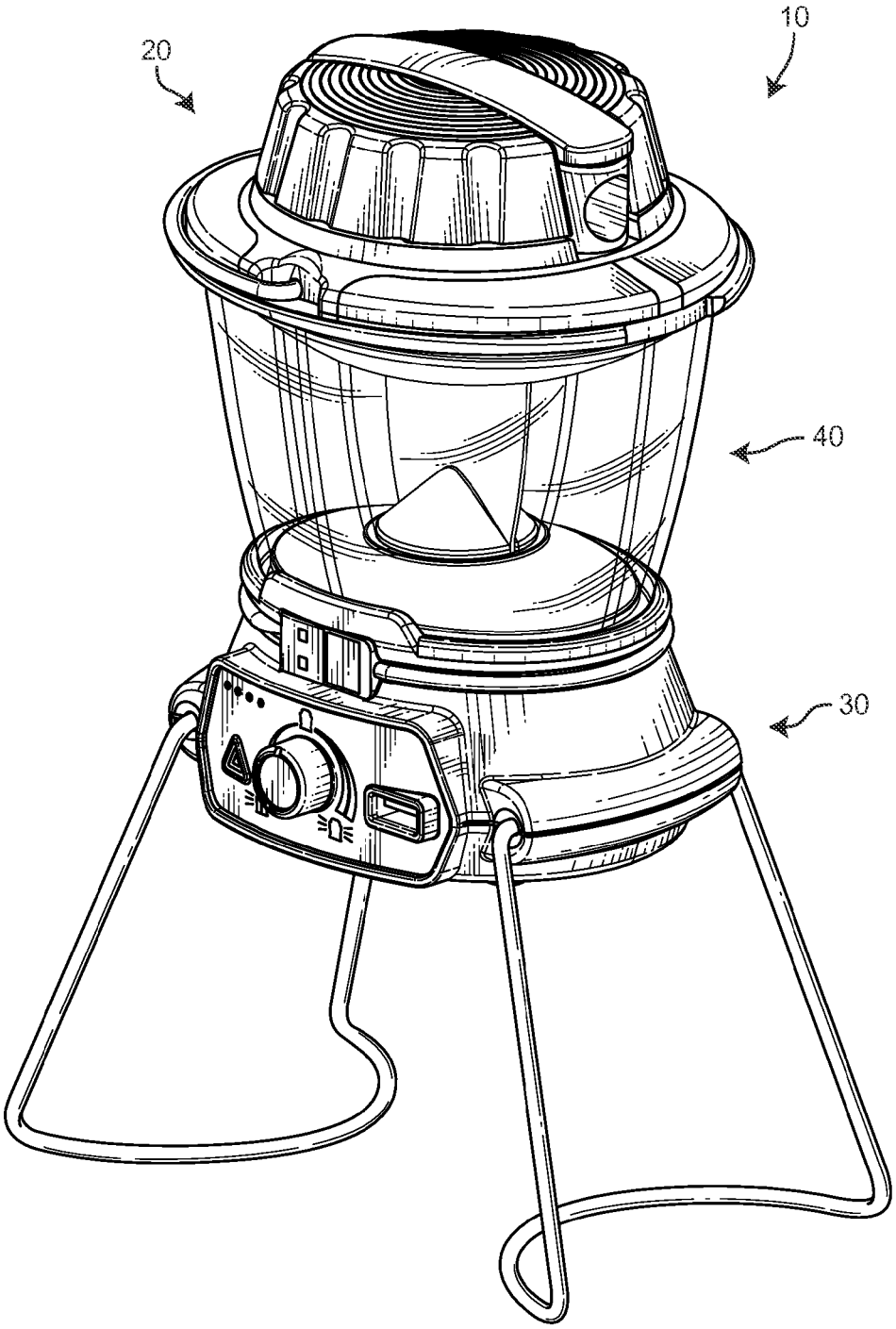
FIG. 8 is a front perspective view of a lighting device having supports in an extended position, according to an exemplary embodiment.
Figure 9:
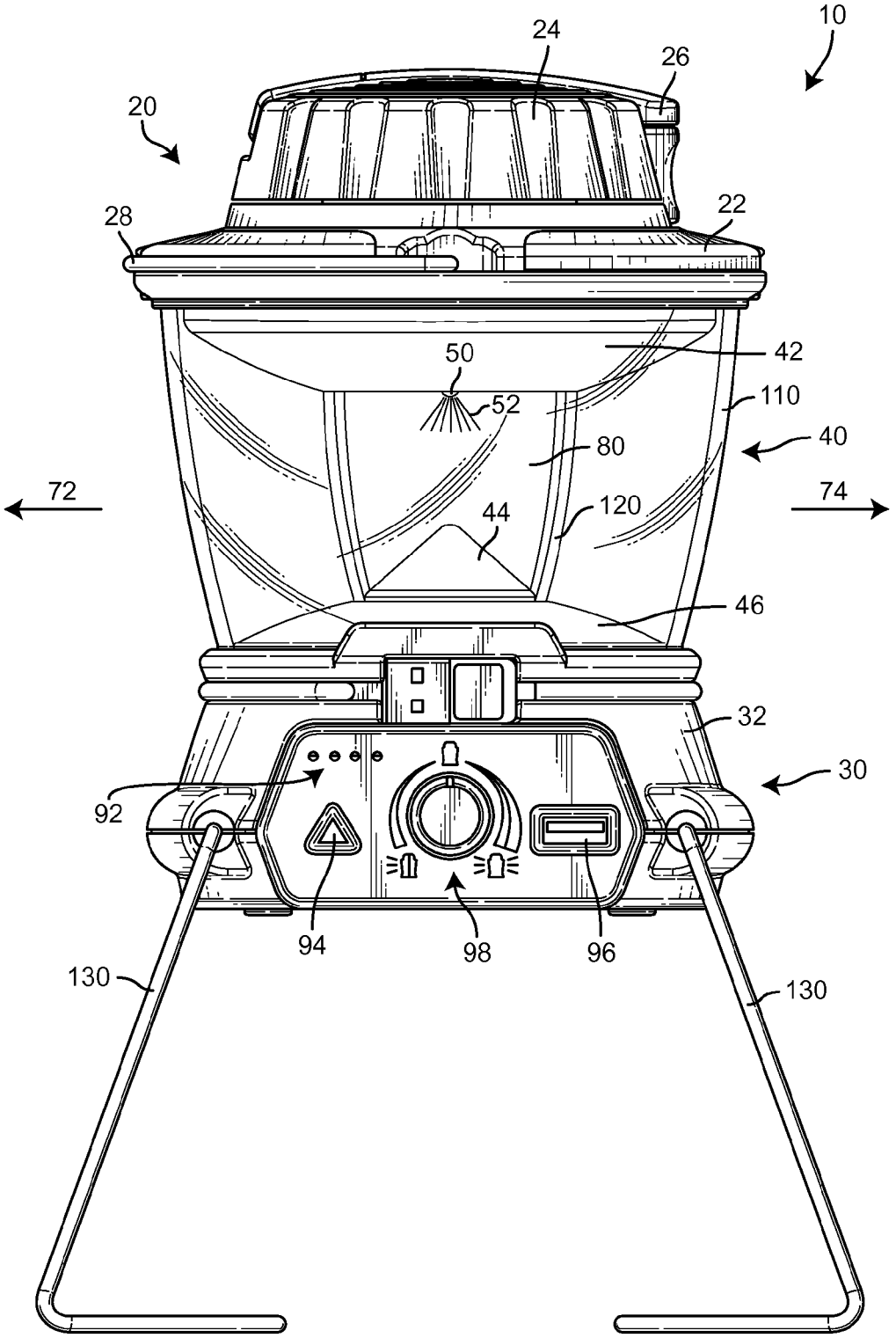
FIG. 9 is a front plan view of the lighting device of FIG. 8.
Figure 10:
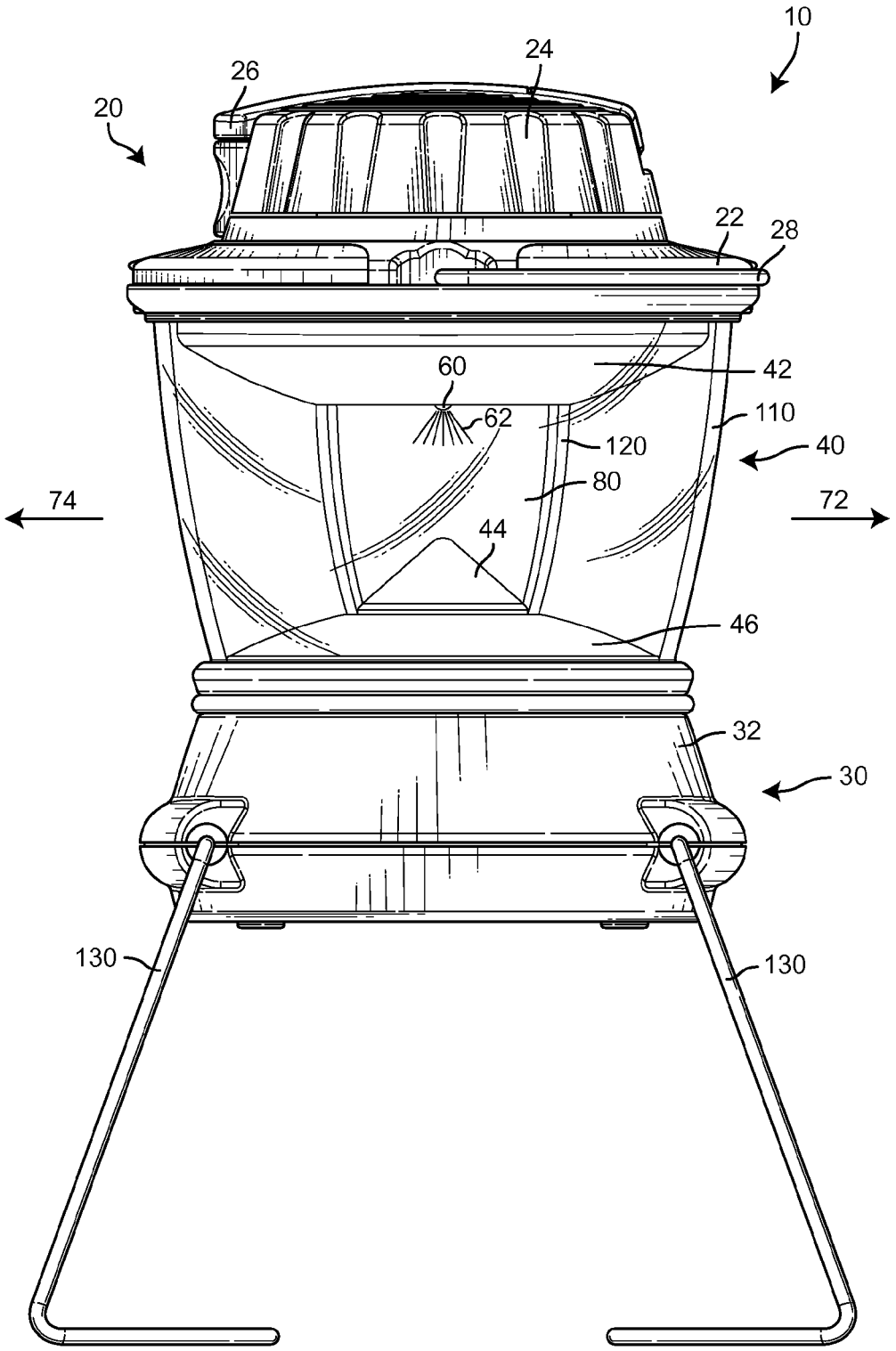
FIG. 10 is a rear plan view of the lighting device of FIG. 8.
Figure 11:
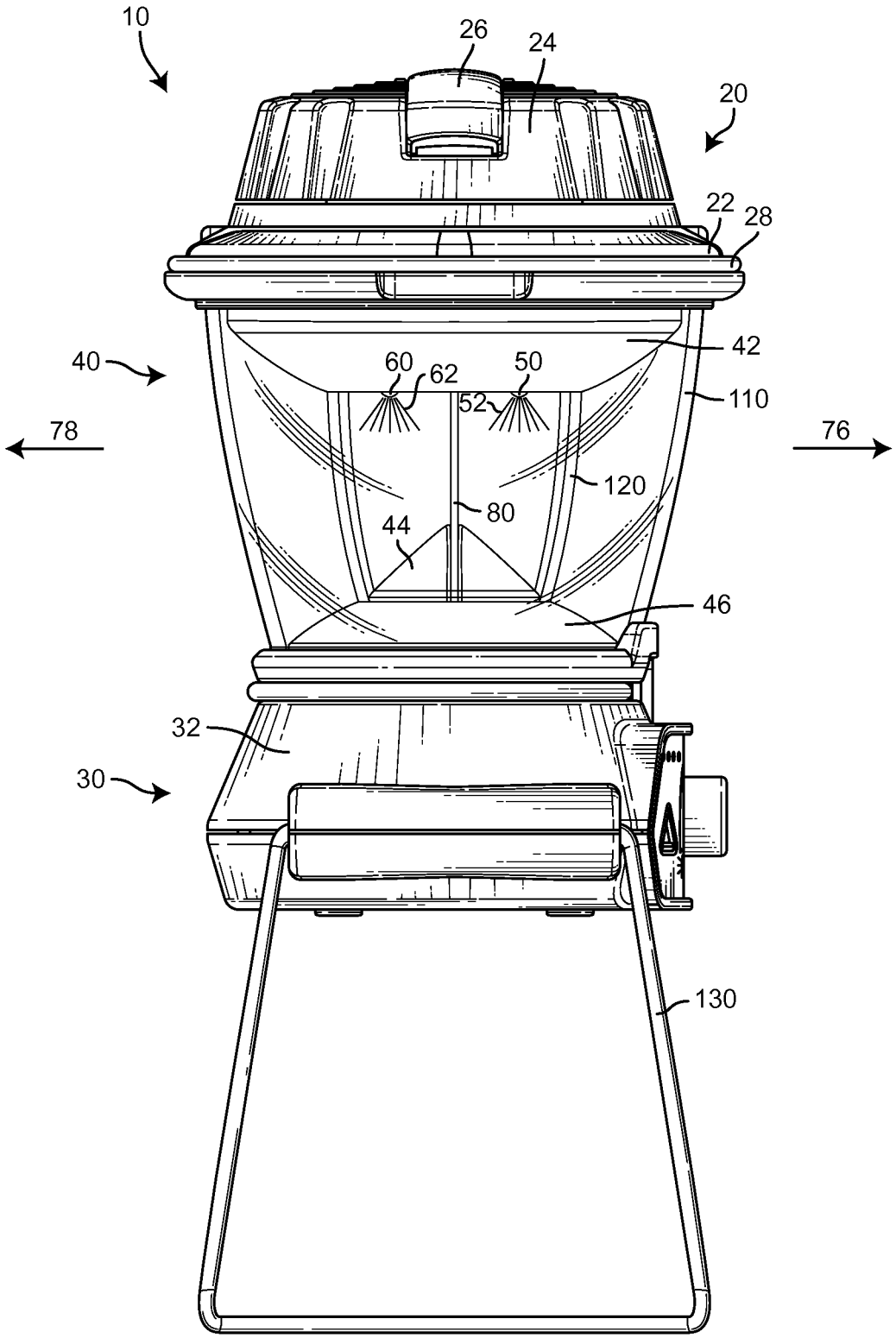
FIG. 11 is a left side plan view of the lighting device of FIG. 8.
Figure 12:
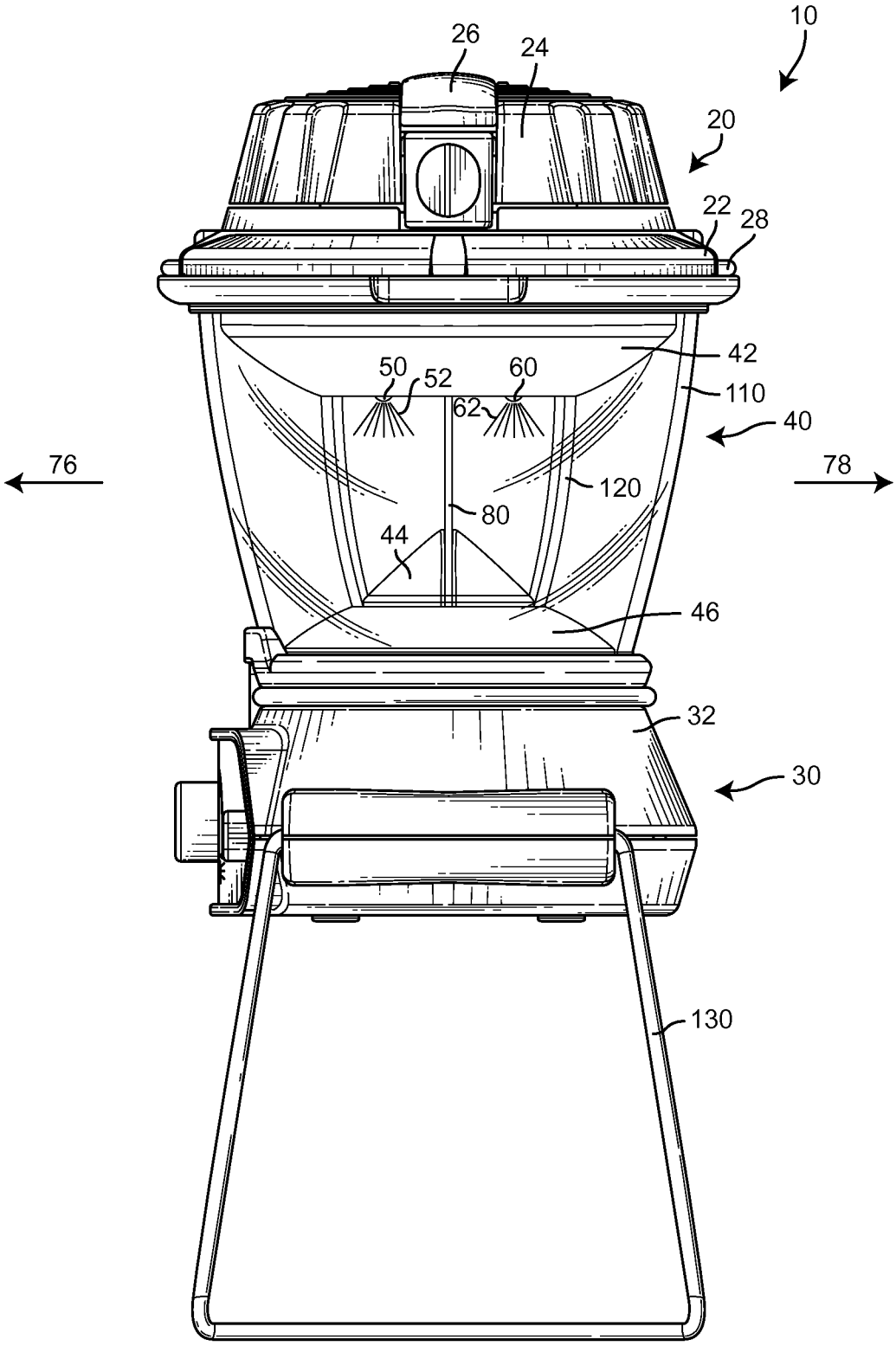
FIG. 12 is a right side plan view of the lighting device of FIG. 8.
Figure 13:
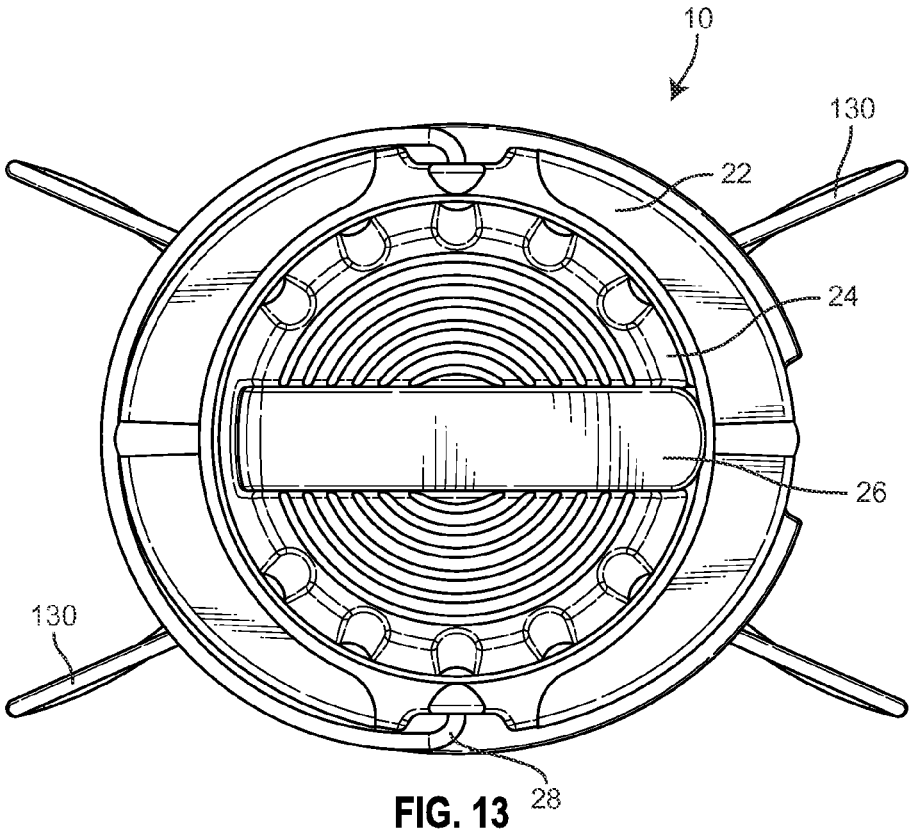
FIG. 13 is a top plan view of the lighting device of FIG. 8.
Figure 14:
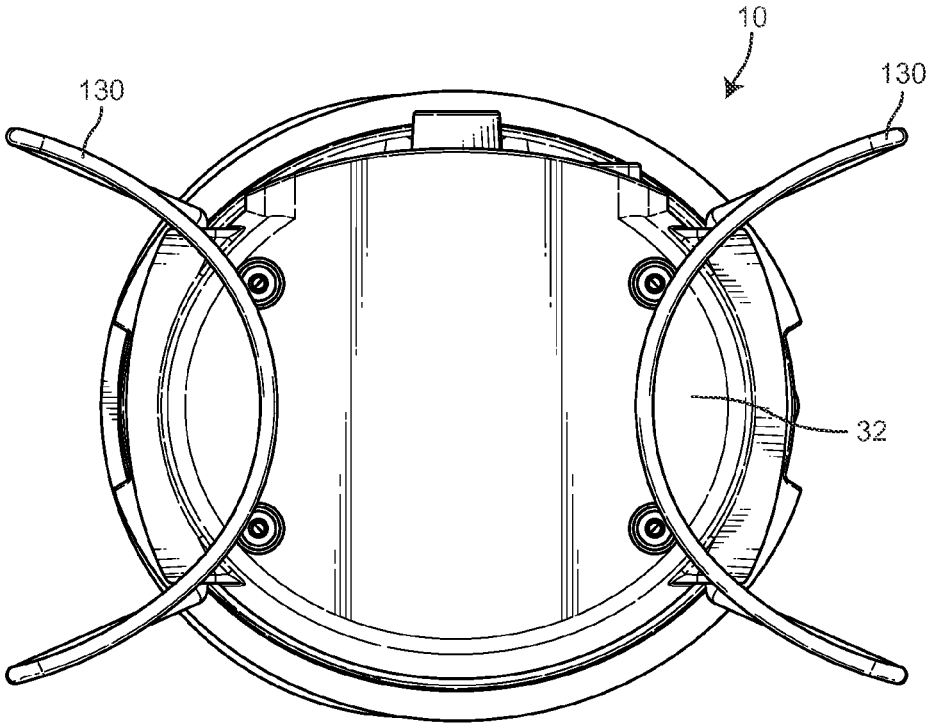
FIG. 14 is a bottom plan view of the lighting device of FIG. 8.

Referring next to top plan view of FIG. 6, divider 80 defines a divider axis 82. As shown in FIG. 6, divider axis 82 extends along the width of divider 80 parallel to left lateral direction 72 and right lateral direction 74. Divider axis 82 bifurcates an illumination circle 84 into a first LED zone 86 and a second LED zone 88, according to an exemplary embodiment. As shown in FIG. 6, first LED zone 86 and second LED zone 88 each extend 180 degrees around illumination circle 84. According to an alternative embodiment, lantern 10 includes more than two illumination zones (e.g., three LEDs positioned such that each directs light to one of three LED zones). According to still another alternative embodiment, divider 80 is otherwise shaped such that first LED zone 86 and second LED zone 88 extend less than 180 degrees around illumination circle 84.

According to an alternative embodiment, lantern 10 includes multiple LEDs associated with each of first LED zone 86 and second LED zone 88. By way of example, lantern 10 may include two or more LEDs in place of LED 50 and two or more LEDs in place of LED 60. Such LEDs may be placed alongside one another or positioned in a pattern (e.g., a triangle, a line, an array, etc.). A plurality of LEDs in place of LED 50 or LED 60 may operate concurrently (e.g., to provide a greater total output light intensity) or may be engaged successively (e.g., to provide a first light intensity range with one LED engaged and a second light intensity range with both LEDs engaged, etc.). Successively engaged LEDs may provide different intensity levels without a rheostat or a device that varies the current provided to the LEDs. According to still another alternative embodiment, lantern 10 includes one or more dividers configured to produce more than two illumination zones. By way of example, the divider may separate light from three LEDs such that each LED provides illumination around approximately 120 degrees of lantern 10.

According to still another alternative embodiment, the first opposing surface and the second opposing surface of divider 80 each define an interface configured to receive LED 50 and LED 60, respectively (i.e., LED 50 and LED 60 may be directly coupled to divider 80). Lantern 10 having LED 50 and LED 60 directly coupled to divider 80 may not include upper reflector 42, intermediate reflector 44, or base reflector 46 and may provide more direct illumination (e.g. to provide a flashlight functionality). Such direct coupling of LED 50 and LED 60 to divider 80 may further reduce the amount of light from LED 50 that extends in the opposing rear direction 78 and the amount light from LED 60 that extends in the front direction 76. According to an exemplary embodiment, the shape of half-intensity cone 52 and half-intensity cone 62 are specified with a lens disposed over LED 50 and LED 60, respectively. In still another alternative embodiment, lantern 10 includes LEDs coupled to upper reflector 42 and divider 80 (e.g., to provide general, partial, and direct illumination).

Base portion 30 includes a base cover, shown as base housing 32, that defines a user interface 90. As shown in FIGS. 1-2, user interface 90 includes a curved surface upon which various components are mounted. As shown in FIG. 2, such components include a charge indicator, shown as battery level indicator lights 92, a switch, shown as alert switch 94, an output port, shown as universal serial bus (hereinafter USB) output port 96, and a controller, shown as selector 98. While shown coupled to user interface 90, any of battery level indicator lights 92, alert switch 94, USB output port 96, and selector 98 may be otherwise positioned on lantern 10. At least one of battery level indicator lights 92, alert switch 94, and selector 98 may include a tactile switch or a membrane switch or may form a portion of a touch screen user interface.

According to an exemplary embodiment, lantern 10 is configured to operate according to a plurality of operation modes. In a first operation mode (e.g., a partial lighting mode), one of LED 50 and LED 60 is engaged, and lantern 10 provides illumination within either of first LED zone 86 and second LED zone 88. In a second operation mode (e.g., a general lighting mode), both LED 50 and LED 60 are engaged and lantern 10 provides illumination within both first LED zone 86 and second LED zone 88. According to an exemplary embodiment, lantern 10 provides approximately 180 degrees of illumination (e.g., within 10 degrees) in the first operation mode and approximately 360 degrees of illumination (e.g., between 340 and 360 degrees) in the second operation mode.

As shown in FIG. 2, selector 98 includes a dial configured to rotate about its central axis. According to an exemplary embodiment, a user may rotate the dial counterclockwise from the position shown in FIG. 2 to activate lantern 10 in the first operation mode or rotate the dial clockwise from the position shown in FIG. 2 to activate lantern 10 in the second operation mode. As shown visually in FIGS. 1-2, selector 98 also allows a user to vary the intensity of the light provided by lantern 10 in both the first and second operation modes. By way of example, selector 98 may include a dimmer (e.g., rheostat, a device configured to vary the current provided to LED 50 and LED 60, etc.). Lantern 10 having a dimmer allows a user to tailor the light output for a particular activity (e.g., reading, etc.), to selectively reduce the electrical power consumption of LED 50 and LED 60, and provides still other advantages.

A user may engage alert switch 94 to activate lantern 10 in an alert mode. In the alert mode, lantern 10 provides signal light. In some embodiments, LED 50 and LED 60 are flashed when lantern 10 is in the alert mode according to a predetermined pattern stored within a memory of lantern 10. In other embodiments, LED 50 and LED 60 flash randomly when lantern 10 is in the alert mode. The alert mode of lantern 10 may include engaging LED 50, LED 60, or still other LEDs. By way of example, lantern 10 may include colored LEDs (e.g., LEDs having red lenses) positioned adjacent LED 50 and LED 60 that are engaged in the alert mode. In other embodiments, at least one of LED 50 and LED 60 are multicolored LEDs and only one of the LED chips (e.g., red, green, blue, etc.) are engaged in the alert mode. While shown in FIG. 2 as having a triangular shape, alert switch 94 may be otherwise shaped and may include text thereon.

The battery level indicator lights 92 provide a user with a visual indication of the electrical energy stored within the energy storage device. As shown in FIG. 2, lantern 10 includes four LEDs, where either zero or one LED is illuminated to indicate a low charge state and four LEDs are illuminated to indicate a fully charged state of the energy storage device. Two and three LEDs are illuminated to show intermediate charging states of the energy storage device (e.g., 25 percent and 50 percent, respectively). Battery level indicator lights 92 may include more than four LEDs, fewer than four LEDs, different types of lights, or still another display. In some embodiments, battery level indicator lights 92 remain illuminated during operation of lantern 10. In other embodiments, battery level indicator lights 92 are turned "off" until a user presses a button or a change in state occurs (e.g., from partially to fully charged, etc.) whereby the battery level indicator lights 92 may flash.

A plurality of circuits electrically couples the various switches, energy storage devices, and charging devices of lantern 10. By way of example, a first circuit may couple LED 50, LED 60, and the lithium-ion battery with selector 98 and alert switch 94. A separate circuit may electrically couple the battery level indicator lights 92 with the lithium-ion battery. In some embodiments, various wires may extend between upper portion 20 and base portion 30 to couple the various components of lantern 10.

According to an exemplary embodiment, a printed circuit board (hereinafter PCB) forms divider 80. Such a divider 80 may couple the components within upper portion 20 to the components within base portion 30. A lantern having a PCB divider 80 may not include additional wires or components extending through intermediate portion 40. In some embodiments, the opposing surfaces of the PCB are coated with a reflective material thereby improving the light output of lantern 10. In other embodiments, the PCB is exposed to view.

According to an exemplary embodiment, lantern 10 is configured to receive input power from various devices. Lantern 10 is also configured to provide output power to various devices (e.g., to charge a cellular phone or another portable electronic device, etc.) via USB output port 96. In one embodiment, USB output port 96 is configured to provide an electrical output for at least one of powering and charging a portable electronic device. In the illustrated embodiment, the energy storage device of lantern 10 may be charged by an external source with a cable, shown as USB cable 100. Charging with an external source may supplement or replace charging the energy storage device with a generator. By way of example, lantern 10 may not include a generator and instead operate by power from replaceable batteries or by input power from an external source, among other alternatives. According to an alternative embodiment, input power from an external source may directly power lantern 10 without charging an energy storage device.

USB cable 100 includes a first end that defines a male USB interface and a wire that electrically couples the male USB interface with base portion 30 of lantern 10. As shown in FIGS. 1-2, the wire is flexible such that USB cable 100 may be wrapped around a portion of base housing 32 and secured in a storage position. A user may unwrap USB cable 100 from base housing 32 and engage an external source with the male USB interface. Such external sources may include a solar panel (e.g., a mobile solar panel), another energy storage device (e.g., a portable battery pack, etc.), and an automobile accessory port, among other alternatives. It should be understood that USB cable 100 may alternatively include a female USB interface or another type of interface end (e.g., a micro USB end, etc.). While shown as a flexible wire wrapped around a portion of base housing 32, USB cable 100 may alternatively include another arrangement of cables and interfaces (e.g., a cable that retracts into base housing 32, a flexible cable that stows within a compartment of base housing 32, a male USB interface coupled to base housing 32 with a detachable cable having female and male ends, etc.).

Referring again to the exemplary embodiment shown in FIGS. 1-7, intermediate portion 40 includes a first cover, shown as lens 110, and a second cover, shown as lens 120. According to an exemplary embodiment, lens 110 and lens 120 include a transparent sidewall intended to allow light to pass therethrough while protecting various internal components of lantern 10 (e.g., upper reflector 42, intermediate reflector 44, base reflector 46, LED 50, LED 60, divider 80, etc.). In other embodiments, a surface treatment (e.g., etching) or a coating (e.g., an adhesive film) is disposed along a surface of at least one of lens 110 and lens 120. A surface treatment or coating may diffuse incident light from LED 50 and LED 60 (e.g., to provide subtle lighting).

As shown in FIGS. 2-3, lens 110 extends between an outer periphery of top plate 22 and an outer periphery of base housing 32. Lens 120 extends between upper reflector 42 and base reflector 46. According to an exemplary embodiment, lens 110 and lens 120 have circular cross-sectional shapes. Lens 110 and lens 120 are tapered and have a diameter that decreases from a first diameter at top plate 22 and upper reflector 42 to a second diameter at base housing 32 and base reflector 46, respectively. As shown in FIG. 2, lens 110 and lens 120 transition non-linearly between the first diameters and the second diameters. In other embodiments, lens 110 and lens 120 may be otherwise shaped (e.g., having a polygonal cross-section, having a diameter that changes linearly, having a ovular shape, having a spherical shape, etc.). As shown in FIGS. 2-3, lens 110 and lens 120 may have similar shapes. In other embodiments, lens 110 and lens 120 may have dissimilar shapes (e.g., lens 110 may be cylindrical, etc.). In still other embodiments, intermediate portion 40 does not include lens 110, does not include lens 120, or includes neither lens 110 nor lens 120.

According to an alternative embodiment, at least one of lens 110 and lens 120 includes a first portion and a second portion. The first portion may have a first shape and the second portion may have a different, second shape configured to further focus or distribute light from LED 50 and LED 60. In some embodiments, the second portion is disposed within the first portion. By way of example, the first portion may be a base lens extending between top plate 22 and base housing 32, and the second portion may be a sub-lens facing front direction 76. A lens 110 or lens 120 having such a first portion and a second portion may change the pattern of light provided by lantern 10 (e.g., to produce a flashlight functionality by focusing a portion of the light with the second portion while still providing distributed illumination with the first portion). In an alternative embodiment, the first portion faces front direction 76 while the second portion faces rear direction 78 (e.g., to provide focused light from one side of lantern 10 and distributed light from the other side of lantern 10). In either embodiment, the first portion or the second portion may be shaped as a spherical, parabolic, Fresnel, or other type of lens.

According to an exemplary embodiment, lantern 10 includes a pair of supports, shown as legs 130. Legs 130 elevate lantern 10 from a ground surface when in use to more completely illuminate a surrounding environment and protect the components of user interface 90 (e.g., from debris). As shown in FIGS. 1-14, legs 130 each include a curved portion extending between a pair of straight portions. In some embodiments, legs 130 are rigid wires that are each rotatably coupled to base housing 32 at a pair of ends. The pair of ends is each received into apertures defined within bosses of base housing 32. Referring to FIGS. 1-7, legs 130 are rotated into a storage position with the curved portions positioned along top plate 22. As shown in FIGS. 8-14, legs 130 may be rotated into an extended position to elevate lantern 10 from a ground surface. In some embodiments, lantern 10 includes a locking mechanism configured to secure legs 130 in at least one of the storage position and the extended position. While a particular configuration is shown in FIGS. 1-14, legs 130 may be otherwise shaped, otherwise coupled to base housing 32, or otherwise actuated between a storage position and an extended position. In still other embodiments, lantern 10 does not include legs 130.

In some embodiments, lantern 10 includes a microprocessor. Such a microprocessor may be configured to send and receive signals from the various energy storage devices, switches, memory, and other components of lantern 10. The microprocessor may also include a module configured to perform various tasks (e.g., determine the charge level of an energy storage device, send a signal indicating that a user is rotating hub 24 such that the microprocessor may send a signal to disengage a charging circuit for USB cable 100, etc.).

The disclosure is described above with reference to drawings. These drawings illustrate certain details of specific embodiments that implement the systems and methods and programs of the present disclosure. However, describing the disclosure with drawings should not be construed as imposing on the disclosure any limitations that may be present in the drawings. The present disclosure contemplates methods, systems, and/or program products on any machine-readable media for accomplishing its operations. The embodiments of the present disclosure may be implemented using an existing computer processor, or by a special purpose computer processor incorporated for this or another purpose or by a hardwired system. Any type of processor may be used (e.g., FPGA, ASIC, ASIP, CPLD, SDS, etc.). Furthermore, no element, component, or method step in the present disclosure is intended to be dedicated to the public, regardless of whether the element, component, or method step is explicitly recited in the claims.

As noted above, embodiments within the scope of the present disclosure may include program products including machine-readable media for carrying or having machine-executable instructions or data structures stored thereon. Such machine-readable media can be any available media, which can be accessed by a general purpose or special purpose computer or other machine with a processor. By way of example, such machine-readable media can comprise RAM, ROM, EPROM, EEPROM, CD ROM or other optical disk storage, magnetic disk storage or other magnetic storage devices, or any other medium (e.g., non-transitory medium) which can be used to carry or store desired program code in the form of machine-executable instructions or data structures and which can be accessed by a general purpose or special purpose computer or other machine with a processor. Combinations of the above are also included within the scope of machine-readable media. Machine-executable instructions comprise, for example, instructions and data, which cause a general-purpose computer, special purpose computer, or special purpose processing machine to perform a certain function or group of functions.

Embodiments of the disclosure may be described in the general context of method steps, which may be implemented in one embodiment by a program product including machine-executable instructions, such as program code, for example, in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represent examples of corresponding acts for implementing the functions described in such steps.

An exemplary system for implementing the overall system or portions of the disclosure might include a general purpose computing device in the form of a computer, including a processing unit, a system memory, and a system bus that couples various system components including the system memory to the processing unit. The system memory may include read only memory (ROM) and random access memory (RAM). The computer may also include a magnetic hard disk drive for reading from and writing to a magnetic hard disk, a magnetic disk drive for reading from or writing to a removable magnetic disk, and an optical disk drive for reading from or writing to a removable optical disk such as a CD ROM or other optical media. The drives and their associated machine-readable media provide nonvolatile storage of machine-executable instructions, data structures, program modules, and other data for the computer.

It should be noted that although the flowcharts provided herein show a specific order of method steps, it is understood that the order of these steps may differ from what is depicted. Also, two or more steps may be performed concurrently or with partial concurrence. Such variation will depend on the software and hardware systems chosen and on designer choice. It is understood that all such variations are within the scope of the disclosure. Likewise, software and web implementations of the present disclosure could be accomplished with standard programming techniques with rule based logic and other logic to accomplish the various database searching steps, correlation steps, comparison steps and decision steps. It should also be noted that the word "component" as used herein and in the claims is intended to encompass implementations using one or more lines of software code, and/or hardware implementations, and/or equipment for receiving manual inputs.

The foregoing description of embodiments of the disclosure have been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated.

What is claimed is:

1. A lantern lighting device, comprising:

a base portion including a user interface;

an upper portion coupled to the base portion and including an upper cover;

an energy storage device disposed within at least one of the base portion and the upper cover;

a first LED coupled to the upper cover and configured to provide a first light output;

a second LED coupled to the upper cover and configured to provide a second light output;

a divider coupled to the base portion and the upper cover, wherein the divider is positioned to form a partition between the first LED and the second LED that separates the first light output from the second light output; and a controller that selectively engages the first LED in a first operation mode to provide approximately 180 degrees of illumination or that engages both the first LED and the second LED in a second operation mode to provide approximately 360 degrees of illumination.

2. The lantern lighting device of claim 1, wherein the divider comprises a printed circuit board.

3. The lantern lighting device of claim 2, wherein the controller includes a dimmer configured to vary an intensity of the first light output and the second light output.

4. The lantern lighting device of claim 3, wherein the upper portion includes a movable hub.

5. The lantern lighting device of claim 4, further comprising a generator at least partially surrounded by the upper cover, wherein the generator is rotatably coupled to the movable hub and electrically coupled to the energy storage device.

6. The lantern lighting device of claim 5, further comprising a cable coupled to the base portion and configured to interface with an external power source to charge the energy storage device.

7. The lantern lighting device of claim 6, further comprising a USB outlet port configured to provide an electrical output for at least one of powering and charging a portable electronic device.

8. The lantern lighting device of claim 7, further comprising a pair of folding legs, wherein the base portion includes a pair of bosses configured to interface with the pair of folding legs.

9. A lantern lighting device, comprising:

a base portion including a user interface;

an upper portion coupled to the base portion and including an upper cover;

an energy storage device disposed within at least one of the base portion and the upper cover;

a divider coupled to the base portion and the upper cover;

a first LED positioned on a first side of the divider and a second LED positioned on a second side of the divider, the divider forming a partition that at least partially separates a first light output of the first LED from a second light output of the second LED; and a plurality of reflectors including a base reflector and an intermediate reflector, wherein the plurality of reflectors are positioned to reflect the first light output and the second light output outward from the base portion.

10. The lantern lighting device of claim 9, wherein the divider protrudes from the intermediate reflector and divides the intermediate reflector into a pair of opposing sides.

11. The lantern lighting device of claim 9, further comprising an intermediate portion coupling the base portion with the upper portion, wherein the divider is disposed along the intermediate portion.

12. The lantern lighting device of claim 11, wherein the intermediate portion includes a cover having a sidewall configured to protect at least one of the divider, the first LED, and the second LED.

13. The lantern lighting device of claim 11, wherein the first LED and the second LED are coupled to the upper cover and positioned to direct the first light output and the second light output downward toward the base portion.

14. The lantern lighting device of claim 13, wherein the intermediate reflector has a cone-shaped surface such that light is reflected along a first lateral direction, a second lateral direction, a front direction, and an opposing rear direction.

15. The lantern lighting device of claim 14, further comprising an upper reflector coupled to the upper cover, wherein the first LED and the second LED are coupled to the upper reflector.

16. The lantern lighting device of claim 14, wherein the cone-shaped surface comprises a reflective material.

17. The lantern lighting device of claim 16, further comprising a controller that selectively engages the first LED in a first operation mode to provide approximately 180 degrees of illumination or both the first LED and the second LED in a second operation mode to provide approximately 360 degrees of illumination.

18. A lantern lighting device, comprising:

a base portion including a user interface;

an upper portion coupled to the base portion and including an upper cover;

an energy storage device disposed within at least one of the base portion and the upper cover;

a first LED coupled to the upper cover and configured to provide a first light output;

a second LED coupled to the upper cover and configured to provide a second light output;

a plurality of reflectors including a base reflector and an intermediate reflector, wherein the plurality of reflectors are positioned to reflect the first light output and the second light output outward from the base portion;

a divider bisecting the plurality of reflectors, wherein the divider is coupled to the base portion and the upper cover, and wherein the divider is positioned to form a partition between the first LED and the second LED that separates the first light output from the second light output; and a controller that selectively engages the first LED in a first operation mode to provide approximately 180 degrees of illumination or that engages both the first LED and the second LED in a second operation mode to provide approximately 360 degrees of illumination.

19. The lantern lighting device of claim 18, wherein the upper portion includes a movable hub and a generator, wherein the generator is at least partially surrounded by the upper cover, and wherein the generator is rotatably coupled to the movable hub and electrically coupled to the energy storage device.

20. The lantern lighting device of claim 19, further comprising:

a cable coupled to the base portion and configured to interface with an external power source to charge the energy storage device; and a USB outlet port configured to provide an electrical output for at least one of powering and charging a portable electronic device.

* * * * *